US009764885B2

(12) United States Patent
Moskovich

(10) Patent No.: US 9,764,885 B2
(45) Date of Patent: Sep. 19, 2017

(54) ORAL CARE IMPLEMENT PACKAGE AND KIT THEREFOR

(71) Applicant: COLGATE-PALMOLIVE COMPANY, New York, NY (US)

(72) Inventor: Robert Moskovich, East Brunswick, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/901,789

(22) PCT Filed: Jul. 2, 2013

(86) PCT No.: PCT/US2013/049094
§ 371 (c)(1),
(2) Date: Dec. 29, 2015

(87) PCT Pub. No.: WO2015/002638
PCT Pub. Date: Jan. 8, 2015

(65) Prior Publication Data

US 2016/0207683 A1 Jul. 21, 2016

(51) Int. Cl.
*B65D 83/10* (2006.01)
*B65D 75/36* (2006.01)
(Continued)

(52) U.S. Cl.
CPC ..... *B65D 75/366* (2013.01); *A46B 9/04* (2013.01); *B65D 75/54* (2013.01); *B65D 2203/00* (2013.01)

(58) Field of Classification Search
CPC ..... B65D 75/366; B65D 75/54; A46B 9/04
(Continued)

(56) References Cited

U.S. PATENT DOCUMENTS 4,044,889 A 8/1977 Orentreich et al.
4,905,830 A * 3/1990 Lin ..... A45C 9/00 206/214
(Continued)

FOREIGN PATENT DOCUMENTS

CN 1244847 A 2/2000
CN 1312481 A 9/2001
(Continued)

OTHER PUBLICATIONS

International Search Report and the Written Opinion of the International Searching Authority issued in International Application PCT/US2013/049094 mailed Apr. 2, 2014.

*Primary Examiner* — Steven A. Reynolds
*Assistant Examiner* — Javier A Pagan

(57) ABSTRACT

Disclosed is an oral care implement package (1), comprising: a front panel (100), at least a portion of the front panel (100) being transparent, a backer (200) connected to the front panel (100) with a space for receiving an oral care implement (400) being provided between the backer (200) and the front panel (100), and a magnifying mirror (310) facing the space and visible through the portion of the front panel (100), the magnifying mirror (3109 being in contact with the backer (200), the front panel (100), or both the backer (200) and the front panel (100). Also disclosed is a kit for an oral care implement package (1).

23 Claims, 2 Drawing Sheets

(51) Int. Cl.
*A46B 9/04* (2006.01)
*B65D 75/54* (2006.01)

(58) Field of Classification Search
USPC ..... 206/362.2, 361, 362.3, 368
See application file for complete search history.

(56) References Cited

U.S. PATENT DOCUMENTS

| | | | | |
|---|---|---|---|---|
| D334,473 | S * | 4/1993 | Volpenhein | D4/104 |
| D423,927 | S * | 5/2000 | Senyuva | D9/415 |
| 6,311,837 | B1 | 11/2001 | Blaustein et al. | |
| 6,945,397 | B2 | 9/2005 | Brattesani et al. | |
| 2004/0173498 | A1 * | 9/2004 | Lee | A45D 42/04 206/581 |
| 2006/0163090 | A1 | 7/2006 | Sugiyama | |

FOREIGN PATENT DOCUMENTS

| | | |
|---|---|---|
| CN | 2790947 Y | 6/2006 |
| DE | 4441376 | 5/1996 |
| EP | 1 006 055 | 6/2000 |
| WO | WO 98/31605 | 7/1998 |
| WO | WO 2010/134051 A1 | 11/2010 |

* cited by examiner

ORAL CARE IMPLEMENT PACKAGE AND KIT THEREFOR

CROSS-REFERENCE TO RELATED PATENT APPLICATIONS

This application is a U.S. national stage application under 35 U.S.C. §371 of PCT Application No. PCT/US2013/049094, filed Jul. 2, 2013, the entirety of which is incorporated herein by reference.

BACKGROUND

The present invention relates to an oral care implement package and to a kit for an oral care implement package.

It is known to supply an oral care implement, such as a toothbrush, in a package, such as a blister package. Typically the package acts to protect the oral care implement during its transport to a point of sale, during its storage at the point of sale, and during its storage at a consumer's location prior to use. Often such a package also includes various indicia for a consumer to identify the source of the oral care implement, its features and its advantages.

Sometimes special or advantageous features of an oral care implement, such as a toothbrush, are small relative to the size of the overall implement, and might not be as visible to a consumer as the manufacturer of the oral care implement would wish. Also, if the special or advantageous features of the implement are not clearly identifiable, the consumer might not be able to easily distinguish the oral care implement from other similar oral care implements, which could result in the consumer purchasing an oral care implement that is not best suited to their needs.

There is a need for an oral care implement package for helping a consumer to view small features of an oral care implement within the package.

BRIEF SUMMARY

An embodiment of the present invention provides an oral care implement package, comprising: a front panel, at least a portion of the front panel being transparent; a backer connected to the front panel with a space for receiving an oral care implement being provided between the backer and the front panel; and a magnifying mirror facing the space and visible through the portion of the front panel, the magnifying mirror being in contact with the backer, the front panel, or both the backer and the front panel.

Optionally, the package comprises the oral care implement ire the space between the front panel and the backer.

Optionally, the oral care implement comprises a toothbrush.

Optionally, the magnifying mirror comprises a recess in which a portion of the oral care implement is located. Further optionally, the portion of the oral care implement comprises at least part of a head of the oral care implement.

Optionally, the recess cooperates with the oral care implement to hold the oral care implement in position relative to the magnifying mirror.

Optionally, the toothbrush comprises a head including bristles, and wherein an enlarged image of the bristles is visible in the magnifying mirror when the magnifying mirror is viewed through the portion of the front panel. Further optionally, the bristles comprise tapered bristles.

Optionally, the magnifying mirror comprises at least one concave reflective surface.

Optionally, the magnifying mirror comprises a concave mirror.

Optionally, the magnifying mirror is comprised in a component discrete from the backer and positioned between the backer and the front panel. Further optionally, the component is immovable relative to the portion of the front panel, or movement of the component relative to the portion of the front panel is restricted. Still further optionally, the front panel comprises at least one engaging portion that engages the component to hold the component in position relative to the portion of the front panel, or to restrict movement of the component relative to the portion of the front panel.

Optionally, the magnifying mirror comprises a reflective portion of the backer. Further optionally, the backer comprises a body and the magnifying mirror comprises reflective material attached to the body. Still further optionally, the reflective material is disposed between the body and the front panel.

Optionally, the portion of the front panel comprises transparent material.

Optionally, the portion of the front panel is an opening through the front panel.

Optionally, the package is a blister package. The package may be a clamshell.

Another embodiment of the present invention provides a kit for an oral care implement package, comprising: a front panel, at least a portion of the front panel being transparent; a backer connected or connectable to the front panel, the backer and the front panel being relatively positionable at a closed position with a space for receiving an oral care implement provided between the backer and the front panel; and a magnifying mirror positionable so as to face the space and to be visible through the portion of the front panel when the backer and the front panel are at the closed position.

Optionally, the magnifying mirror comprises at least one concave reflective surface.

Optionally, the magnifying mirror comprises a concave mirror.

Optionally, the magnifying mirror is comprised in a component discrete from the backer and positionable between the backer and the front panel.

Optionally, the front panel comprises at least one engaging portion for engaging the component to hold the component in position relative to the portion of the front panel.

Optionally, the magnifying mirror comprises a reflective portion of the backer. Further optionally, the backer comprises a body and the magnifying mirror comprises reflective material attached to the body. Still further optionally, the reflective material is disposed between the body and the front panel when the backer and the front panel are at the closed position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
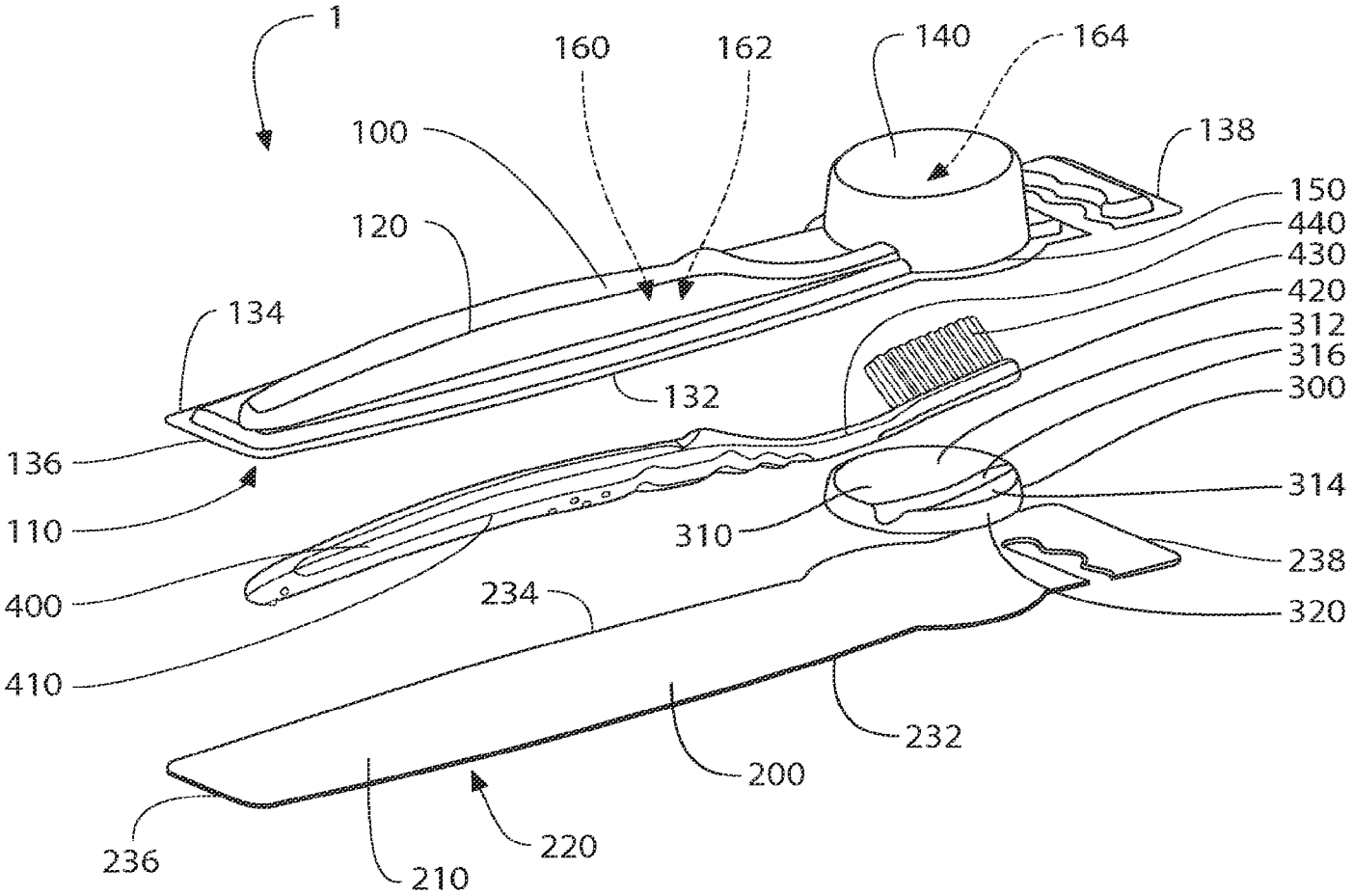
FIG. 1 is an exploded view of components of an oral care implement package according to a first embodiment of the present invention.

FIG. 1 shows an exploded view of components of an oral care implement package 1 according to a first embodiment of the present invention. In short, the package 1 of the illustrated first embodiment is a blister package, or blister pack, comprising a front panel 100, a backer 200, and a component 300 comprising a magnifying mirror 310. Each of these components will be described in turn.

In the illustrated first embodiment, the front panel 100 is formed of a plastic material, such as polyvinyl chloride (PVC). The front panel 100 may have been made by thermoforming a film or sheet of the plastic material. The front panel 100 has a first face 110, an opposite second face 120 and a plurality of edges 132, 134, 136, 138 joining the first face 110 to the second face 120. The first face 110 is contoured to define a substantially planar rim and a cavity or space 160 having an opening surrounded by the rim. The space 160 is suitable for receiving or accommodating an oral care implement. The front panel 100 is thin and the second face 120 of the front panel 100 tends to follow the contours of the inner face. Accordingly, the second face 120 of the front panel 100 includes a bulge corresponding to the space 160.

In the illustrated first embodiment, the oral care implement to be received in the space 160 is a toothbrush 400. The toothbrush comprises a handle 410, a head 420, a plurality of bristles 430 extending from the head 420, and a neck 440 joining the handle 410 to the head 420. Some or all of the bristles 430 are tapered bristles. By "tapered bristle" it is meant that at least a distal end portion of the bristle furthest from the head 420 is tapered, optionally to a pointed tip.

A first portion 162 of the space 160 is for receiving or accommodating the handle 410 and a portion of the neck 440 of the toothbrush 400, while a second portion 164 of the space 160 is for receiving or accommodating the head 420, the bristles 430 and the remainder of the neck 440 of the toothbrush 400.

While the first portion 162 of the space 160 has a shape similar to that of the portion of the toothbrush 400 to be accommodated therein, the second portion 164 of the space 160 has a substantially cylindrical shape. The front panel 100 further includes a substantially planar window portion 140 through which a consumer is able to view the second portion 164 of the space 160 and the portion of the toothbrush 400 therein when the package 1 is assembled.

In the illustrated embodiment, the whole of the front panel 100 is formed of a transparent material, so the whole of the front panel 100 is transparent. By "transparent" it is meant that light is able to pass through the material with little or no scattering, so that it is possible for a consumer to see through the material. In variations to the illustrated first embodiment, one or more portions of the front panel 100 may not be transparent. For example, the one or more portions may be opaque. However, even in these variations the window portion 140 is transparent.

Moreover, in the illustrated first embodiment, the transparent window portion 140 of the front panel 100 comprises, indeed is, transparent material. However, in a variation to the illustrated first embodiment, the transparent window portion 140 may be an opening through the front panel 100 through which the second portion 164 of the space 160 is in fluid communication with an exterior of the package 1.

In the illustrated first embodiment, the backer 200 is discrete from the front panel 100. By "discrete", it is meant that the front panel 100 and the backer 200 are separate, distinct components of the package 1 and are not unitary, or integrally formed. Nevertheless, when the package 1 is fully assembled, the front panel 100 is in contact with the backer 200, as will be described in more detail below. In the illustrated first embodiment, the backer 200 is formed of a plastic material, such as PVC, and may have been made by thermoforming a film or sheet of the plastic material. The backer 200 is a planar, or substantially planar, body that has a first face 210, an opposite second face 220 and a plurality of edges 232, 234, 236, 238 joining the first face 210 to the second face 220.

In respective variations to the illustrated first embodiment, the backer 200 may be formed of paper, card, cardboard, a combination of any two or, all of paper, card, and cardboard, or a combination of one or more plastic materials and any one, two or all of paper, card, and cardboard. Other suitable materials for the backer 200 will be apparent to the skilled person. The backer 200 may comprise a plurality of layers. Neighboring layers may comprise different material(s).

The magnifying mirror 310 is comprised in a component 300 that is discrete from each of the front panel 100 and the backer 200. Nevertheless, when the package 1 is fully assembled, the component 300 comprising the magnifying mirror 310 is positioned between and in contact with both the front panel 100 and the backer 200, as will be described in more detail below. In the illustrated first embodiment, the component 300 comprises a body formed of a plastic material, such as PVC or polypropylene (PP), that may have been made by thermoforming a film or sheet of the plastic material or by injection molding the plastic material. The body of the component 300 is substantially disc shaped, has a circular outer side 320, and has a concave upper face. In the illustrated first embodiment, a reflective material, such as a metal foil, is adhered or otherwise provided to the concave upper face of the body thereby forming the magnifying mirror 310. Put another way, the magnifying mirror 310 comprises a concave mirror 310. In the illustrated first embodiment, the concave upper face comprises two concave reflective surfaces 312, 314 separated by a recess 316 formed in the component 300, the purpose of which recess 316 will be explained below. In a variation to this arrangement, the body may be transparent and the reflective material may be adhered or otherwise fixed on the convex lower face of the body.

In a variation to the illustrated first embodiment, the component 300 comprising the magnifying mirror 310 may be fully coated with a reflective material, or may be made fully from a reflective material, such as a metal. In any event, the magnifying mirror 310 is for reflecting light that is visible to humans. Preferably, the component 300 and/or the magnifying mirror 310 is opaque or substantially opaque, so that all or most, respectively, of visible light incident on the magnifying mirror 310 is reflected.

Together but unassembled, the combination of the front panel 100, the backer 200, and the component 300 comprising the magnifying mirror 310 is a kit fir an oral care implement package 1. Assembly of the front panel 100, the backer 200, and the component 300 comprising the magnifying mirror 310 to form the package 1 around the oral care implement 400 may be carried out as follows.

First, the oral care implement 400 is positioned in the space 160 with the handle 410 and a portion of the neck 440 in the first portion 162 of the space 160 and the head 420, the bristles 430 and the remainder of the neck 440 of the toothbrush 400 in the second portion 164 of the space 160. The component 300 comprising the magnifying mirror 310 is then brought into contact with the oral care implement 400, so that a portion of the oral care implement 400 becomes located in the recess 316. In the illustrated first embodiment, the portion of the oral care implement 400 located in the recess 116 comprises at least a part of the head 420 of the implement 400. Location of the portion of the oral care implement 400 in the recess 316 acts to maintain the relative position of the oral care implement 400 and the magnifying mirror 310. That is, the recess 316 cooperates with the oral care implement 400 to hold the oral care implement 400 in position relative to the magnifying mirror 310, or at least to restrict movement of the oral care implement 400 relative to the magnifying mirror 310.

Moreover, locating portion of the oral care implement 400 in the recess 316 when the oral care implement 400 is located in the space 160 results in the component 300 becoming located at least partially in the second portion 164 of the space 160, with the circular outer side 320 of the body of the component 300 in contact with a circular engaging portion 150 of the front panel 100, and with the magnifying mirror 310 facing the space 160 and visible through the transparent window portion 140 of the front panel 100. The engaging portion 150 of the front panel 100 engages the circular outer side 320 of the body of the component 300 to hold the component 300 in position relative to the transparent window portion 140, so that the component 300 and the magnifying mirror 310 are immovable relative to the transparent window portion 140, or at least so that movement of the component 300 and the magnifying mirror 310 relative to the transparent window portion 140 is restricted.

The backer 200 is then connected to the front panel 100. More specifically, the first face 210 of the backer 200 is brought into contact with the first face 110 of the front panel 100 to close the opening of the space 160, whereby the space 160 is between the front panel 100 and the backer 200 with the front panel 100 and the backer 200 together delimiting the space 160. In this state, the front panel 100 and the backer 200 are considered to be at a relative closed position. The edges 232, 234, 236, 238 of the backer 200 are then joined to the respective edges 132, 134, 136, 138 of the front panel 100 so as to connect the backer 200 to the front panel 100. The joining may comprise interlocking or welding the edges 232, 234, 236, 238 of the backer 200 to the edges 132, 134, 136, 138 of the front panel 100, or may involve additional components such as adhesive or staples. Suitable mechanisms for connecting the backer 200 to the front panel 100 will be apparent to the skilled person.

Once the package 1 is assembled as discussed above with the oral care implement 400 in the space 160 between the front panel 100 and the backer 200, an enlarged image of the tapered bristles 430 of the toothbrush 400 is visible in the magnifying mirror 310 when the magnifying mirror 310 is viewed through the transparent portion 140 of the front panel 100. Accordingly, a consumer viewing the package 1 is better able to view the tapered bristles 430 of the oral care implement 400 within the package 1. Preferably, the degree of magnification is controlled by the degree of concavity of the magnifying mirror 310.

In a variation to the above-described method of assembly of the package 1 of the first embodiment, the portion of the oral care implement 400 may be located in the recess 316 prior to the oral care implement 400 being located in the space 160. The oral care implement 400 and at least a portion of the component 300 are subsequently located in the space 160, and the backer 200 and the front panel 100 are then connected to each other.

Figure 2:
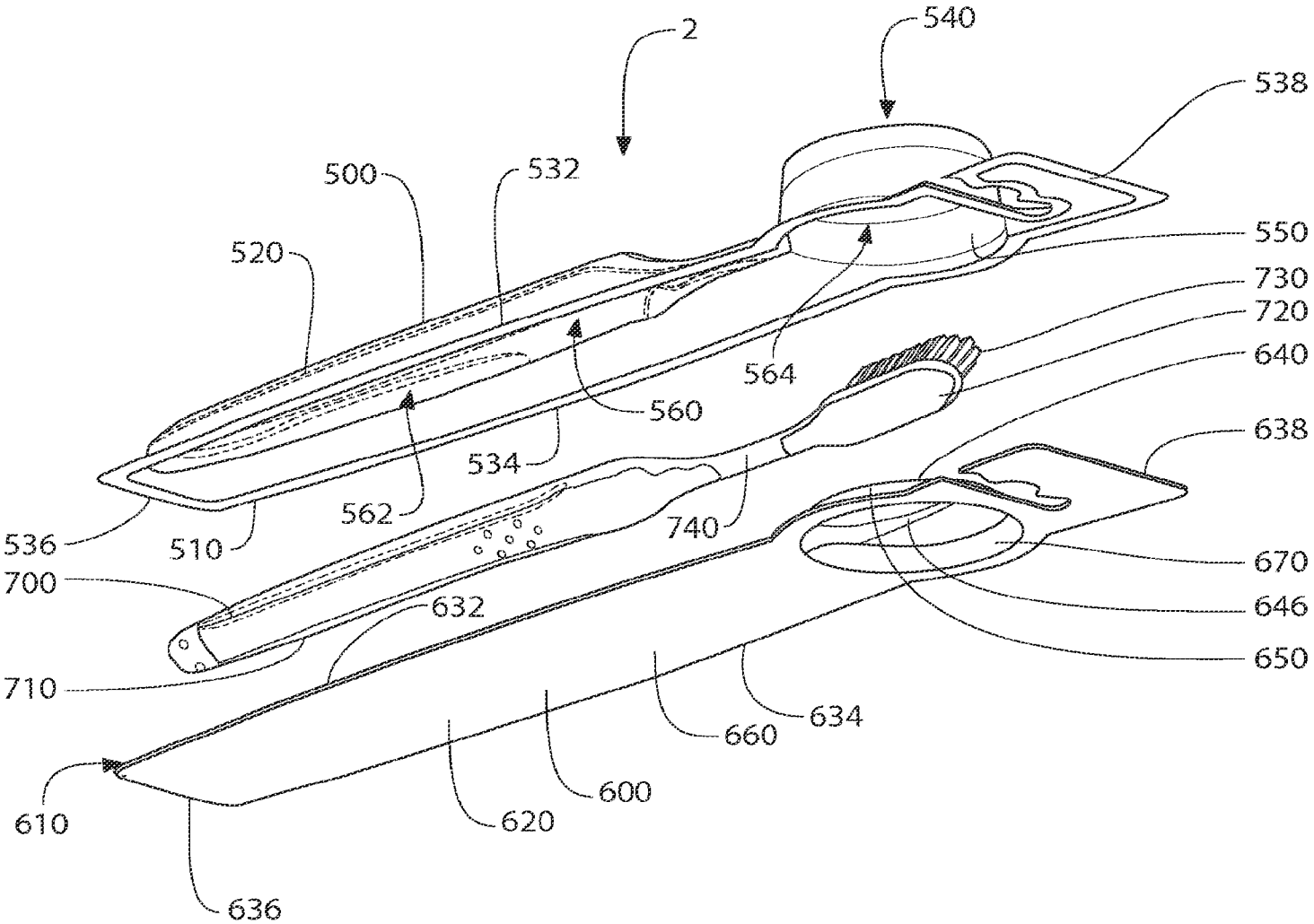
FIG. 2 is an exploded view of components of an oral care implement package according to a second embodiment of the present invention.

FIG. 2 shows an exploded view of components of an oral care implement package 2 according to a second embodiment of the present invention. In short, the package 2 of the illustrated second embodiment is a blister package, or blister pack, comprising a front panel 500 and a backer 600 comprising a magnifying mirror 640.

The front panel 500 of the second embodiment is identical to the front panel 100 of the first embodiment and so a detailed description thereof is omitted. Like features of the front panel 500 of the second embodiment and the front panel 100 of the first embodiment are indicated in FIG. 2 with like reference numerals to those used in FIG. 1, except that each of the reference numerals in FIG. 2 is prefixed with a "5" rather than a "1". All of the possible variations to the front panel 100 of the first embodiment discussed above are equally applicable to the front panel 500 of the second embodiment.

The backer 600 of the second embodiment has many features in common with the backer 200 of the first embodiment and so a full description thereof is omitted. Like features of the backer 600 of the second embodiment and the backer 200 of the first embodiment are indicated in FIG. 2 with like reference numerals to those used in Figure it, except that each of the reference numerals in FIG. 2 is prefixed with a "6" rather than a "2". All of the possible variations to the backer 200 of the first embodiment discussed above are equally applicable to the backer 600 of the second embodiment.

The oral care implement 700 of the second embodiment is identical to the oral care implement 400 of the first embodiment and so a detailed description thereof is omitted. Like features of the oral care implement 700 of the second embodiment and the oral care implement 400 of the first embodiment are indicated in FIG. 2 with like reference numerals to those used in FIG. 1, except that each of the reference numerals in FIG. 2 is prefixed with a "7" rather than a "4". All of the possible variations to the oral care implement 400 of the first embodiment discussed above are equally applicable to the oral care implement 700 of the second embodiment.

The package 2 of the second embodiment differs from the package 1 of the first embodiment primarily in that the magnifying mirror 640 of the package 2 of the second embodiment comprises a reflective portion of the backer 600, rather than being comprised in a component that is discrete from the backer 600. More specifically, the backer 600 comprises a body 660 and the magnifying mirror 640 comprises reflective material attached to the body 660 so that, when the package 2 of the second embodiment is fully assembled with the front panel 500 and the backer 600 at the relative closed position, the reflective material is disposed between the body 660 of the backer 600 and the front panel 500.

In the illustrated second embodiment, the body 660 of the backer 600 is formed of a plastic material, such as polyvinyl chloride (PVC) or polypropylene (PP), that may have been made by thermoforming a film or sheet of the plastic material or by injection molding the plastic material. The body 660 is contoured so as to define a substantially disc shaped portion 670, which has a circular outer side 650 and a concave upper face. In the illustrated second embodiment, a reflective material, such as a metal foil, is adhered or otherwise provided to the concave upper face of the body 660, i.e. the first side 610 of the backer 600, of the backer thereby forming the magnifying mirror 640. Put another way, the magnifying mirror 640 comprises a concave mirror 640. Similarly to the first embodiment, in the illustrated second embodiment, the concave upper face comprises two concave reflective surfaces separated by a recess 646 formed in the disc shaped portion 670 of the backer 600. In a variation to this arrangement, the disc shaped portion 670 may be transparent and the reflective material may be adhered or otherwise fixed on the convex lower face of the disc shaped portion 670, i.e. the second side 620 of the backer 600.

In a variation to the illustrated second embodiment, the body 660 of the backer 600 comprising the magnifying mirror 640 may be fully coated with a reflective material, or may be made fully from a reflective material, such as a metal. In any event, as in the first embodiment, the magnifying mirror 640 is for reflecting light that is visible to humans. Preferably, the disc shaped portion 670 and/or the magnifying mirror 640 is opaque or substantially opaque, so that all or most, respectively, of visible light incident on the magnifying mirror 640 is reflected.

Together but unassembled, the combination of the front panel 500 and the backer 600 comprising the magnifying mirror 640 is a kit for an oral care implement package 2. Assembly of the front panel 500 and the backer 600 comprising the magnifying mirror 640 to form the package 2 around the oral care implement 700 may be carried out as follows.

First, the oral care implement 700 is positioned in the space 560 with the handle 710 and a portion of the neck 740 in the first portion 562 of the space 560 and the head 720, the bristles 730 and the remainder of the neck 740 of the toothbrush 700 in the second portion 564 of the space 560. The backer 600 comprising the magnifying mirror 640 is then brought into contact with the oral care implement 700, so that a portion of the oral care implement 700 becomes located in the recess 646. In the illustrated second embodiment, the portion of the oral care implement 700 located in the recess 646 comprises at least a part of the head 720 of the implement 700. Location of the portion of the oral care implement 700 in the recess 646 acts to maintain the relative position of the oral care implement 700 and the magnifying mirror 640. That is, the recess 646 cooperates with the oral care implement 700 to hold the oral care implement 700 in position relative to the magnifying mirror 640, or at least to restrict movement of the oral care implement 700 relative to the magnifying mirror 640.

Moreover, the locating of the portion of the oral care implement 700 in the recess 646 when the oral care implement 700 is located in the space 560 results in the disc shaped portion 670 of the backer 600 becoming located at least partially in the second portion 564 of the space 560, with the circular outer side 650 of the disc shaped portion 670 in contact with a circular engaging portion 550 of the front panel 500, and with the magnifying mirror 640 facing the space 560 and visible through the transparent window portion 540 of the front panel 500. The engaging portion 550 of the front panel 500 engages the circular outer side 520 of the disc shaped portion 670 of the backer 600 to hold the backer 600 in position relative to the transparent window portion 540, so that backer 600 and the magnifying mirror 640 are immovable relative to the transparent window portion 540, or at least so that movement of the backer 600 and the magnifying mirror 640 relative to the transparent window portion 540 is restricted.

The backer 600 is then connected to the front panel 500. More specifically, the first face 610 of the backer 600 is brought into contact with the first face 510 of the front panel 500 to close the opening of the space 560, whereby the space 560 is between the front panel 500 and the backer 600 with the front panel 500 and the backer 600 together delimiting the space 560. In this state, the front panel 500 and the backer 600 are considered to be at a relative closed position. The edges 632, 634, 636, 638 of the backer 600 are then joined to the respective edges 532, 534, 536, 538 of the front panel 500 so as to connect the backer 600 to the front panel 500. The joining may comprise interlocking or welding the edges 632, 634, 636, 638 of the backer 600 to the edges 532, 534, 536, 538 of the front panel 500, or may involve additional components such as adhesive or staples. Suitable mechanisms for connecting the backer 600 to the front panel 500 will be apparent to the skilled person.

Once the package 2 is assembled as discussed above with the oral care implement 700 in the space 560 between the front panel 500 and the backer 600, an enlarged image of the tapered bristles 730 of the toothbrush 700 is visible in the magnifying mirror 640 when the magnifying mirror 640 is viewed through the transparent portion 540 of the front panel 500. Accordingly, a consumer viewing the package 2 is better able to view the tapered bristles 730 of the oral care implement 700 within the package 2. Preferably, the degree of magnification is controlled by the degree of concavity of the magnifying mirror 640.

In a variation to the above-described method of assembly of the package 2 of the second embodiment, the portion of the oral care implement 700 may be located in the recess 646 prior to the oral care implement 700 being located in the space 560. The oral care implement 700 and at least a portion of the disc shaped portion 670 of the backer 600 are subsequently located in the space 560, and the backer 600 and the front panel 500 are then connected to each other.

In each of the above-described embodiments, the oral care implement has tapered bristles and it is an enlarged image of the tapered bristles that is visible in the magnifying mirror when the magnifying mirror is viewed through the transparent portion of the front panel of the package. In respective variations to these embodiments, some or all of the bristles may have a form other than tapered. For example, the bristles may be spiral shaped or have particular cross sectional shapes or distal tip profiles, which it would be desirable for a consumer to be able to view clearly.

In still further variations to each of the above-described embodiments, the oral care implement may be an implement other than a toothbrush. For example, the implement may be a tongue scraper or a soft tissue cleaner. Nevertheless, an enlarged image of a small feature of the implement is visible in the magnifying mirror when the magnifying mirror is viewed through the transparent portion of the front panel of the package.

In each of the above-described embodiments, the magnifying mirror, the transparent window portion and the oral care implement are relatively positioned so that an enlarged image of a small feature of the head of the implement is visible in the magnifying mirror when the magnifying mirror is viewed through the transparent portion of the front panel of the package. In respective variations to these embodiments, the magnifying mirror, the transparent window portion and the oral care implement are relatively positioned so that an enlarged image of a small feature of a part or portion of the implement other than the head, such as the handle, a user interface, or the neck, is visible in the magnifying mirror when the magnifying mirror is viewed through the transparent portion of the front panel of the package.

Still further, in each of the above-described embodiments, the front panel and the backer are discrete components of the package. In respective variations to these embodiments, the front panel may be unitary with the backer. By "unitary", it is meant that the backer is integrally formed with the front panel. That is, the backer and the front panel are one piece, so that the package is what is known in the art as a clamshell. In such variations, the clamshell would be foldable about a line between the backer and the front panel to position the backer and the front panel at the relative closed position with the space for receiving the oral care implement provided between the backer and the front panel.

While in each of the above-described embodiments at least a majority of the backer, or a body of the backer, is planar, in variations to these embodiments the backer may be non-planar. The rim of the front panel may also be non-planar, yet still co-operable with the backer to enable positioning of the backer and the front panel at the relative closed position with the space for receiving an oral care implement being provided between the backer and the front panel.

In further variations to the above-described embodiments, the recess formed in the component comprising the magnifying mirror, or the recess formed in the disc shaped portion of the backer comprising the magnifying mirror, may be omitted.

In still further variations to the above-described embodiments, the component comprising the magnifying mirror, or the portion of the backer comprising the magnifying mirror, may have a shape other than a disc shape.

What is claimed is:

1. An oral care implement package, comprising:

a front panel, at least a portion of the front panel being transparent;

a backer connected to the front panel with a space for receiving an oral care implement being provided between the backer and the front panel; and a magnifying mirror facing the space and visible through the portion of the front panel, the magnifying mirror being in contact with the backer or the front panel, or both the backer and the front panel, the magnifying mirror comprising:

a first concave reflective surface;

a second concave reflective surface; and a recess separating the first concave surface from the second concave surface, wherein the recess is configured to receive a portion of the oral care implement and to restrict movement of the oral care implement relative to the magnifying mirror.

2. The package of claim 1, comprising the oral care implement in the space between the front panel and the backer.

3. The package of claim 2, wherein the oral care implement comprises a toothbrush.

4. The package of claim 3, wherein:

the toothbrush comprises a head including bristles;

at least a portion of the head is received within the recess; and an enlarged image of the bristles is visible in the magnifying mirror when the magnifying mirror is viewed through the portion of the front panel.

5. The package of claim 4, wherein the bristles comprise tapered bristles.

6. The package of claim 1, wherein the portion of the oral care implement comprises at least part of a head of the oral care implement.

7. The package of claim 1, wherein the recess cooperates with the oral care implement to hold the oral care implement in position relative to the magnifying mirror.

8. The package of claim 1, wherein the magnifying mirror is comprised in a component discrete from the backer and positioned between the backer and the front panel.

9. The package of claim 8, wherein the component is immovable relative to the portion of the front panel, or wherein movement of the component relative to the portion of the front panel is restricted.

10. The package of claim 8, wherein the front panel comprises at least one engaging portion that engages the component to hold the component in position relative to the portion of the front panel, or to restrict movement of the component relative to the portion of the front panel.

11. The package of claim 1, wherein the magnifying mirror comprises a reflective portion of the backer.

12. The package of claim 11, wherein the backer comprises a body and the magnifying mirror comprises reflective material attached to the body.

13. The package of claim 12, wherein the reflective material is disposed between the body and the front panel.

14. The package of claim 1, wherein the portion of the front panel comprises transparent material.

15. The package of claim 1, wherein the portion of the front panel is an opening through the front panel.

16. The package of claim 1, wherein the package is a blister package.

17. A kit for an oral care implement package, comprising:

a front panel, at least a portion of the front panel being transparent;

a backer connected or connectable to the front panel, the backer and the front panel being relatively positionable at a closed position with a space for receiving an oral care implement provided between the backer and the front panel; and a magnifying mirror positionable so as to face the space and to be visible through the portion of the front panel when the backer and the front panel are at the closed position, the magnifying mirror comprising:

a first concave reflective surface;

a second concave reflective surface; and a recess separating the first concave surface from the second concave surface, wherein the recess is configured to receive a portion of the oral care implement and to restrict movement of the oral care implement relative to the magnifying mirror.

18. The kit of claim 17, wherein the magnifying mirror is comprised in a component discrete from the backer and positionable between the backer and the front panel.

19. The kit of claim 18, wherein the front panel comprises at least one engaging portion for engaging the component to hold the component in position relative to the portion of the front panel.

20. The kit of claim 17, wherein the magnifying mirror comprises a reflective portion of the backer.

21. The kit of claim 20, wherein the backer comprises a body and the magnifying mirror comprises reflective material attached to the body.

22. The kit of claim 21, wherein the reflective material is disposed between the body and the front panel when the backer and the front panel are at the closed position.

23. The kit of claim 17, wherein the oral care instrument comprises a toothbrush comprising a head including bristles, wherein:

at least a portion of the head is received within the recess; and an enlarged image of the bristles is visible in the magnifying mirror when the magnifying mirror is viewed through the portion of the front panel.

* * * * *